US010986966B2

(12) United States Patent
Tojek et al.

(10) Patent No.: US 10,986,966 B2
(45) **Date of Patent: *Apr. 27, 2021**

(54) SLIDE OPEN REFILLABLE DISPENSER

(71) Applicant: GOJO Industries, Inc., Akron, OH (US)

(72) Inventors: Andrew P. Tojek, Garfield Heights, OH (US); Touby Khamphilapanyo, Cuyahoga Falls, OH (US)

(73) Assignee: GOJO Industries, Inc., Akron, OH (US)

( * ) Notice: Subject to any disclaimer, the term of this patent is extended or adjusted under 35 U.S.C. 154(b) by 0 days.

This patent is subject to a terminal disclaimer.

(21) Appl. No.: 16/691,826

(22) Filed: Nov. 22, 2019

(65) Prior Publication Data

US 2020/0163496 A1 May 28, 2020

Related U.S. Application Data

(60) Continuation of application No. 16/209,316, filed on Dec. 4, 2018, now Pat. No. 10,485,385, which is a division of application No. 15/281,832, filed on Sep. 30, 2016, now Pat. No. 10,149,575.

(60) Provisional application No. 62/238,897, filed on Oct. 8, 2015.

(51) Int. Cl.

| | |
|---|---|
| ***A47K 5/12*** | (2006.01) |
| ***B05B 15/62*** | (2018.01) |
| ***B05B 9/04*** | (2006.01) |
| ***E05B 13/00*** | (2006.01) |
| ***E05B 65/00*** | (2006.01) |
| *A47K 5/14* | (2006.01) |

(52) U.S. Cl.

CPC ..... *A47K 5/1211* (2013.01); *A47K 5/12* (2013.01); *B05B 9/0426* (2013.01); *B05B 15/62* (2018.02); *E05B 13/002* (2013.01); *E05B 65/006* (2013.01); *A47K 5/14* (2013.01)

(58) Field of Classification Search

CPC ..... A47K 5/1211; A47K 5/12; A47K 5/14; B05B 15/62; B05B 9/0426; E05B 13/002; E05B 65/006

USPC ..... 222/52, 173, 180, 181, 325, 518

See application file for complete search history.

(56) References Cited

U.S. PATENT DOCUMENTS

| | | | |
|---|---|---|---|
| 4,722,372 | A | 2/1988 | Hoffman |
| 5,465,877 | A | 11/1995 | Bell |
| 5,810,204 | A | 9/1998 | Devlin et al. |
| 5,897,031 | A | 4/1999 | Wirt |
| 5,992,698 | A | 11/1999 | Copeland |
| 7,232,045 | B2 | 6/2007 | Ophardt |
| 7,270,250 | B2 | 9/2007 | Jones |
| 7,299,951 | B2 | 11/2007 | Jahnke |
| 7,367,477 | B2 | 5/2008 | Ophardt |
| 7,527,178 | B2 | 5/2009 | Lewis |
| 7,568,598 | B2 | 8/2009 | Ophardt et al. |
| 7,735,694 | B2 | 6/2010 | Brown |

(Continued)

FOREIGN PATENT DOCUMENTS

| | | |
|---|---|---|
| WO | 2015/070016 A2 | 5/2015 |
| WO | 2015126538 A1 | 8/2015 |

*Primary Examiner* — Vishal Pancholi

(74) *Attorney, Agent, or Firm* — Calfee, Halter & Griswold LLP

(57) ABSTRACT

An exemplary dispenser includes a base having at least one rail, a cover, and a mounting portion for a refill unit having a container for fluid. The cover is slideable along at least one rail of the base between a closed position and an open position.

20 Claims, 9 Drawing Sheets

(56) References Cited

U.S. PATENT DOCUMENTS

| | | | |
|---|---|---|---|
| 7,798,370 | B2 | 9/2010 | Ciavarella |
| 8,245,877 | B2 | 8/2012 | Ophardt |
| 8,245,881 | B2 | 8/2012 | Ophardt |
| 2008/0029545 | A1 | 2/2008 | Jahnke et al. |
| 2009/0302061 | A1 | 12/2009 | Ophardt |
| 2015/0190827 | A1 | 7/2015 | Ophardt et al. |

SLIDE OPEN REFILLABLE DISPENSER

RELATED APPLICATIONS

This application claims priority to, and the benefits, of U.S. patent application Ser. No. 16/209,316, titled Slide Open Refillable Dispensers, which was filed on Dec. 4, 2018 and which will issue as U.S. Pat. No. 10,485,385 on Nov. 26, 2019 and U.S. Pat. No. 10,149,575 titled Slide Open Refillable Dispensers filed on Sep. 30, 2016 and which issued on Dec. 11, 2018 and to Application Serial No. U.S. Provisional Patent application No. 62/238,897 titled Slide Open Refillable Dispenser, which was filed on Oct. 8, 2015. Each of which are incorporated herein by reference in their entirety.

TECHNICAL FIELD

The present invention relates generally to dispenser systems, such as liquid soap and sanitizer dispensers.

BACKGROUND OF THE INVENTION

Liquid and foam dispensing systems, such as soap and sanitizer dispensers, provide a user with a predetermined amount of liquid or foam upon actuation of the dispenser. Most prior art dispensers that are wall mounted have a base that is secured to a wall or surface. A cover is hingedly connected to the base (typically at the bottom). The cover rotates open. Refill units are typically loaded downward. Because the wall or mounting surface extends beyond the base, the cover typically can open only 90° making it difficult for a short person to refill the dispenser. In addition, while the cover is open, it may be struck and broken.

SUMMARY

Exemplary embodiments of dispensers, refill units, and pumps with variable output are disclosed herein.

In one exemplary embodiment, a dispenser includes a base having at least one rail and a cover that is slideable along at least one rail of the base between a closed position and an open position. The dispenser also includes a refill unit that is removable from the dispenser. The refill unit has a container, a pump, and an outlet. When the cover is in the open position the refill unit may be inserted into the dispenser along a horizontal axis. When the cover is in the closed position the cover at least partially encloses the pump of the refill unit. At least a portion of the refill unit is exposed when the cover is in a closed position and the refill unit is installed in the dispenser.

In another exemplary embodiment, a dispenser includes a refill unit having a battery pod, a receptacle on the dispenser for receiving the battery pod, and a sliding cover. The sliding cover slides downward to open and allow access to the refill unit, and the sliding cover slides upward to close and prevent the refill unit from being removed.

In another exemplary embodiment, a dispenser includes at least one rail, a latch, a sliding cover, and a refill unit. The at least one rail has a first end and a second end, the latch being disposed at the first end of the rail. The sliding cover is slidable along the at least one rail between a closed position at the first end of the rail and an open position at the second end of the rail. The refill unit includes a container, a pump, and a nozzle. When the cover is in the closed position, the cover covers at least a portion of the refill unit and leaves a portion of the refill unit exposed. The cover is held in the closed position by the latch. The refill unit cannot be removed when the cover is in the closed position.

BRIEF DESCRIPTION OF THE DRAWINGS

These and other features and advantages of the present invention will become better understood with regard to the following description and accompanying drawings in which.

DETAILED DESCRIPTION

Figure 1A:
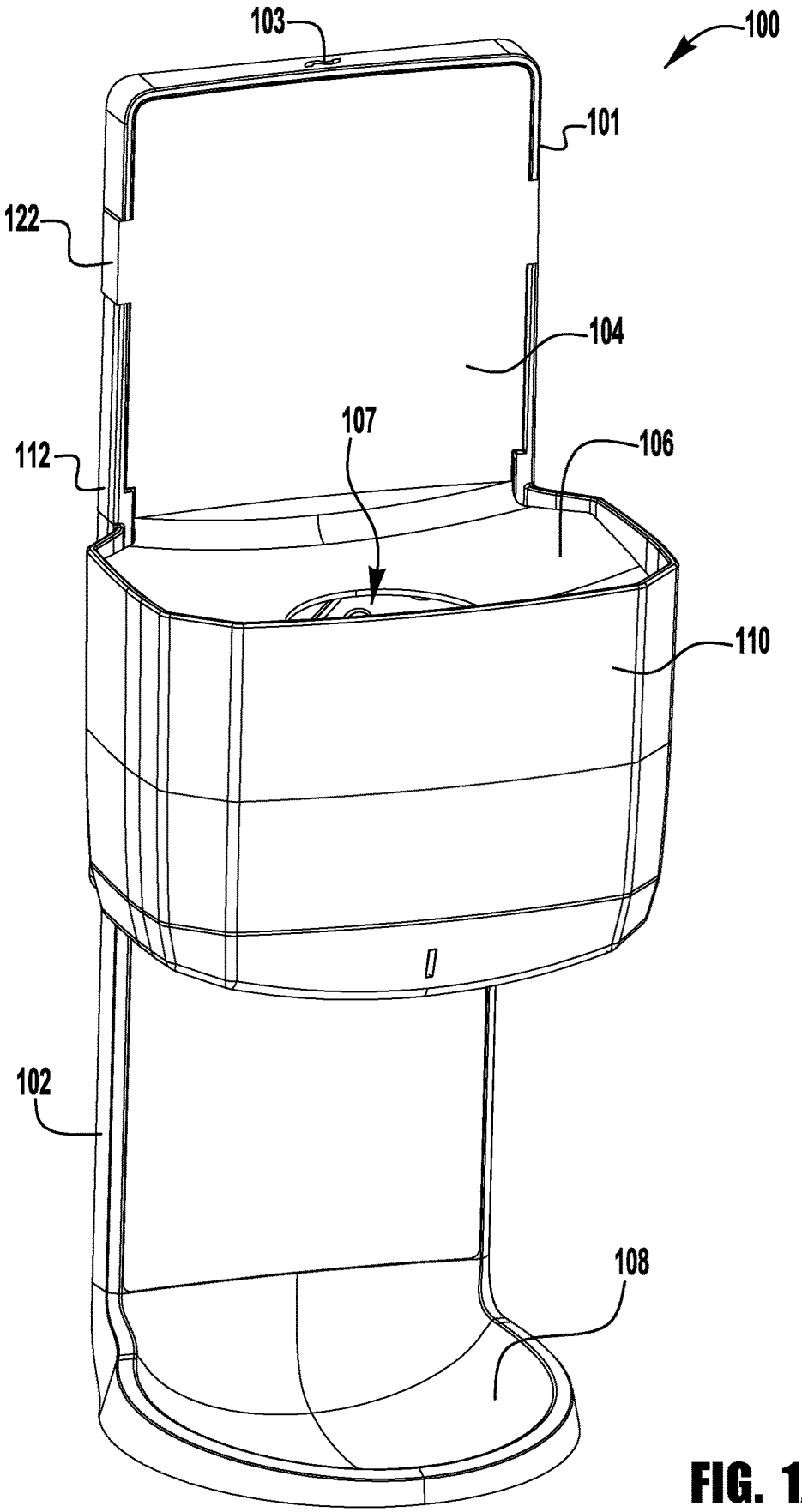
FIG. 1A is a perspective view of an exemplary dispenser with a closed cover.
Figure 1B:
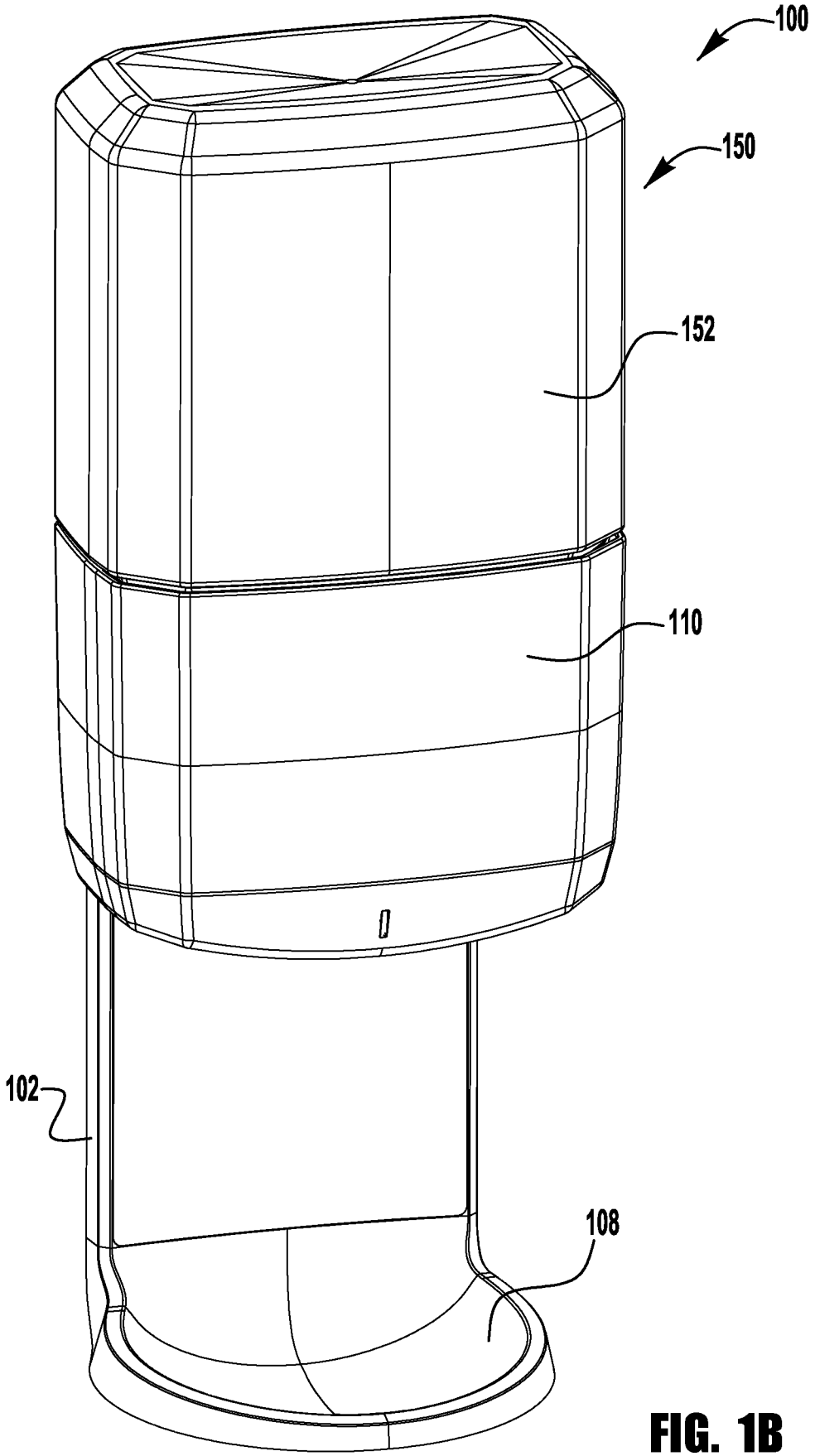
FIG. 1B is a perspective view of an exemplary refill unit installed in an exemplary dispenser with a closed cover.
Figure 1C:
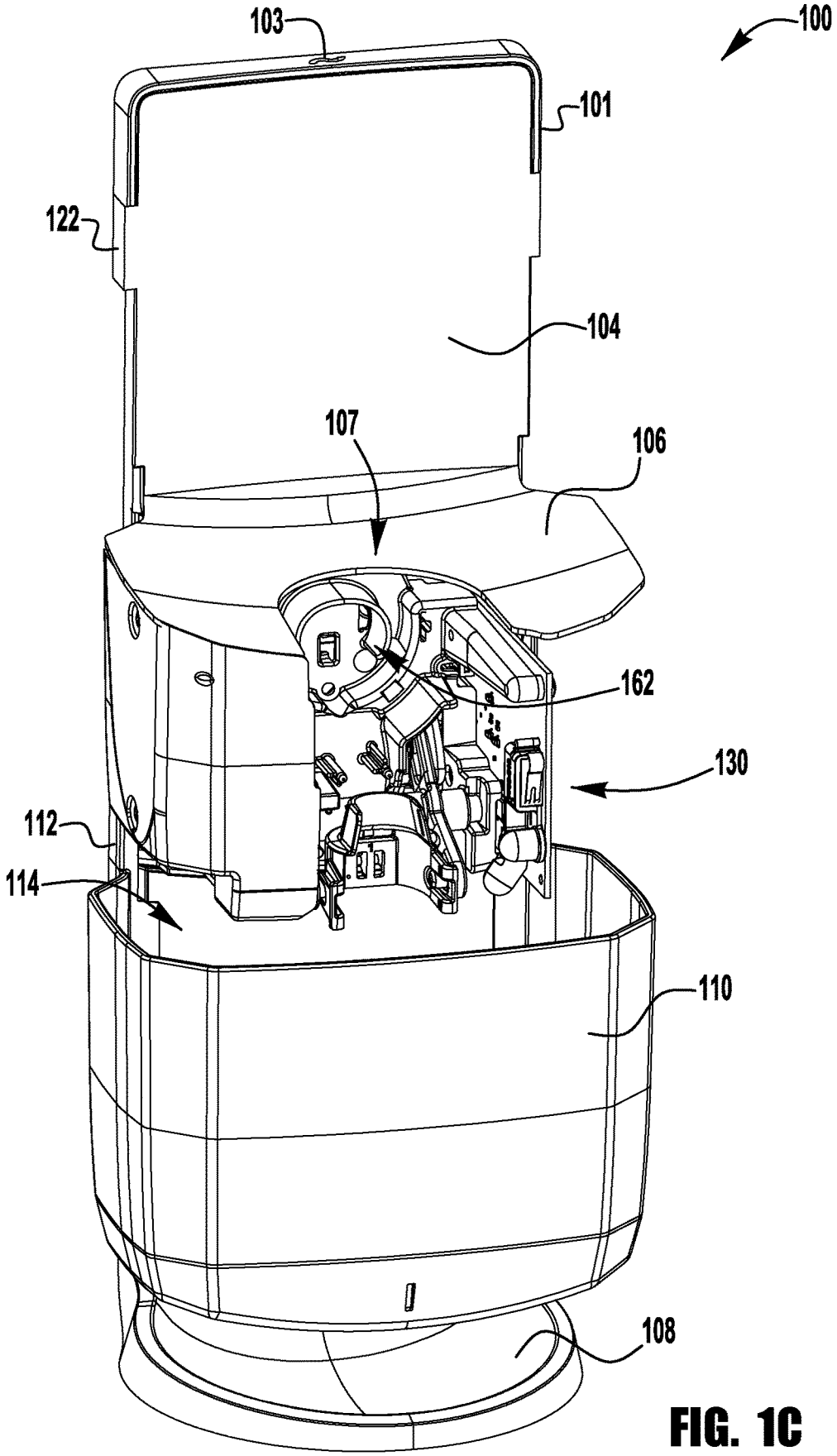
FIG. 1C is a perspective view of an exemplary dispenser with an open cover.
Figure 1D:
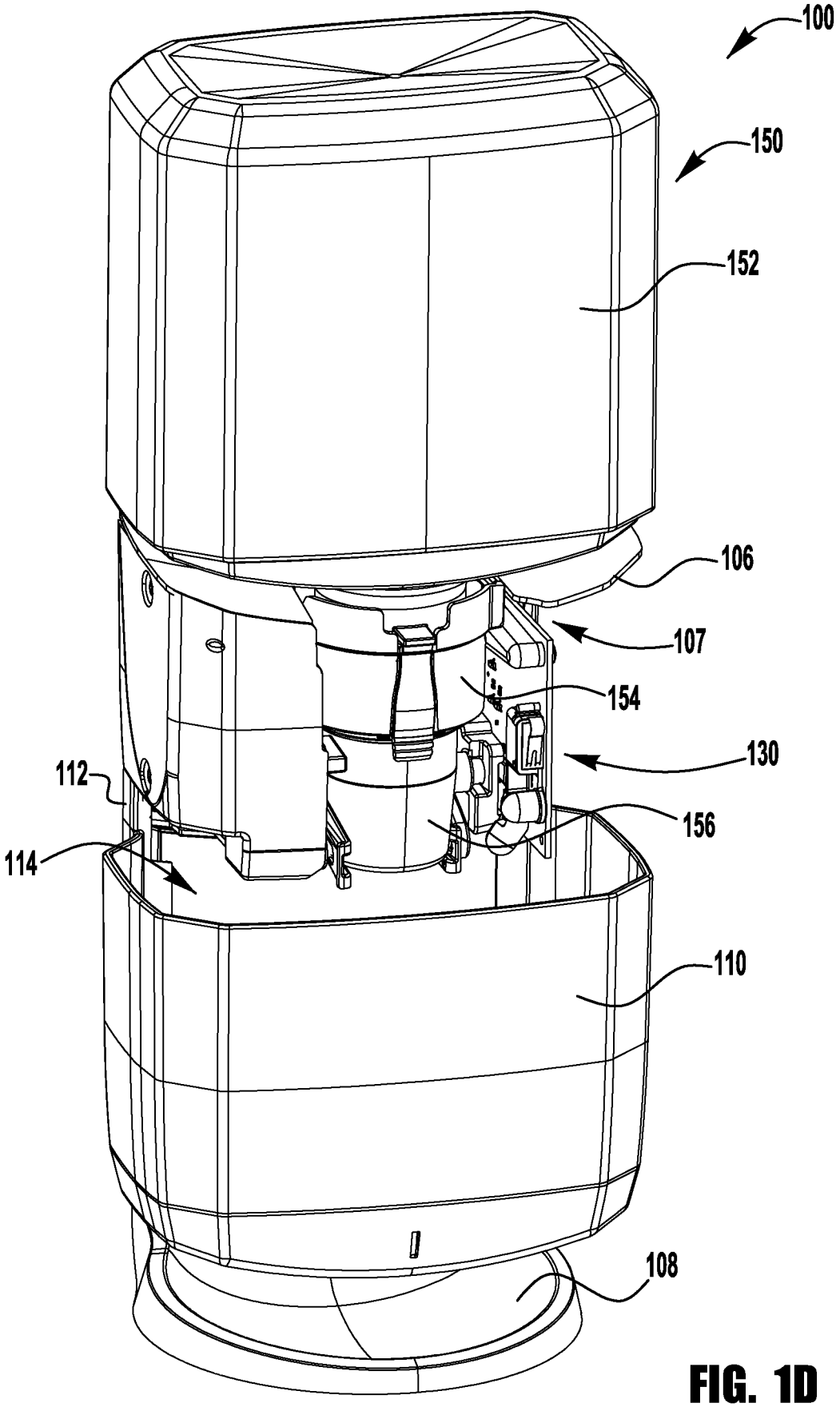
FIG. 1D is a perspective view of an exemplary refill unit installed in an exemplary dispenser with an open cover.
Figure 1E:
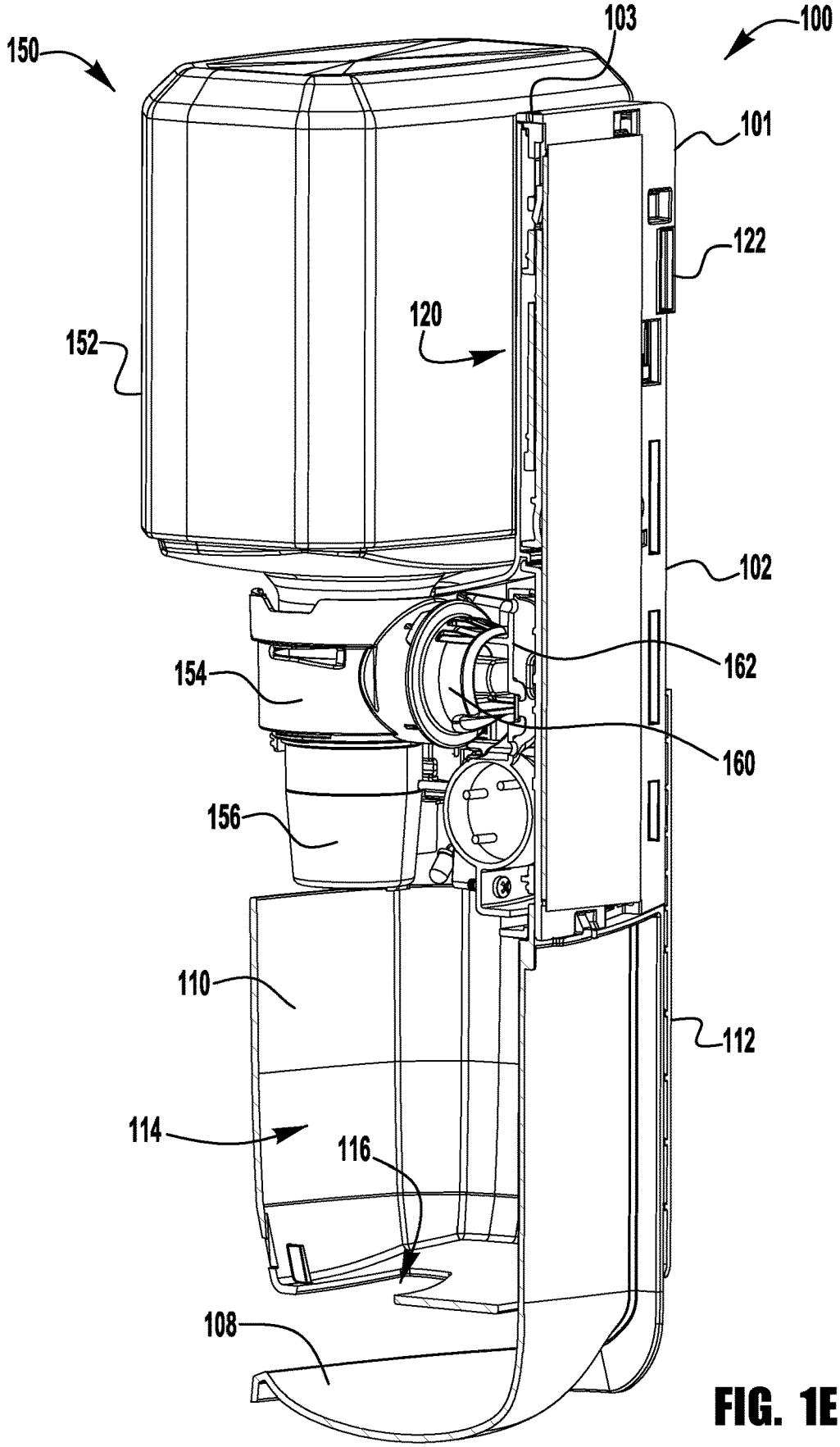
FIG. 1E is a cross-sectional view of an exemplary refill unit installed in an exemplary dispenser with an open cover.

FIGS. 1A to 1E illustrate an exemplary dispenser 100 with a sliding cover 110. The dispenser includes a base 101 that has two rails 102. The cover 110 is slideably attached to the rails 102 and is slideable between a closed position shown in FIGS. 1A and 1B, and an open position shown in FIGS. 1C, 1D, and 1E. In some embodiments, the base 101 has only one rail 102. In other embodiments, the base 101 has more than two rails 102. Though the illustrated embodiment shows the cover 110 sliding downward when opened, the cover in other embodiments may slide upward, or to the side, or any other direction. In other embodiments, the cover may even be split into two or more portions, each sliding in a different direction when the cover is opened.

Figure 2A:
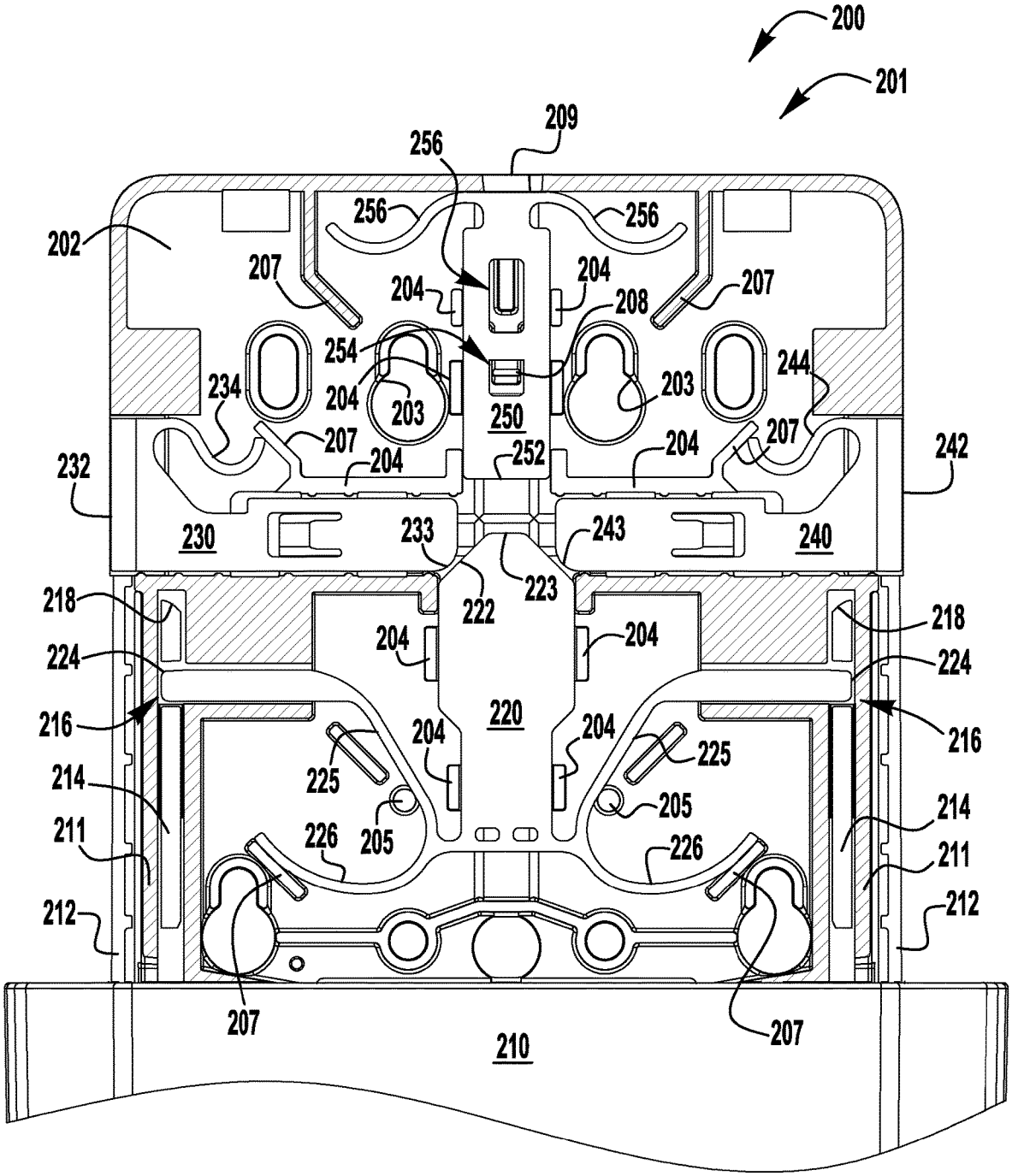
FIG. 2A is a elevational view of an exemplary dispenser (with the top plate removed) with a closed latch.

The dispenser 100 includes a latch (not shown) that engages the cover 110. In FIGS. 1A-1D, the latch (not shown, but described in detail with respect to FIGS. 2A-2C) is covered by a top plate 104 of the base 101. The latch (not shown) is biased to remain closed, and is opened by pressing on an actuation member 122. Releasing the actuation member 122 allows the latch (not shown) to close. The closed latch retains the cover 110 in its closed position. Opening the latch allows the cover 110 to slide to its open position. When open, the cover 110 can be closed regardless of the state of the latch. The latch can be locked so it cannot be opened by pressing on the actuation member 122. Inserting a key (not shown) into a key aperture 103 in the base 101 locks the latch.

In some embodiments, a base 106 at least partially supports a refill unit 150 (FIGS. 1B, 1D, 1E) which is received in a receptacle 107. When closed, the cover 110 and refill unit 150 conceal the base 106. Opening the cover 110 provides access to receptacle 107 so that a refill unit 150 can be installed in the receptacle 107 of the dispenser 100. When the refill unit 150 is installed in the dispenser 100, a pump 154 of the refill unit 150 is engaged by a drive unit 130 of the dispenser 100. The drive unit 130 actuates the pump 154 to dispense liquid or foam from the refill unit 150. The refill unit 150 is inserted (and removed) along a horizontal axis. In some embodiments, so that a battery pod 160 is located on refill unit 150 and engages a battery receptacle 162 of the dispenser 100. The cover 110 is then closed to cover at least a portion of the refill unit 150. The cover 110 prevents the refill unit 150 from being removed when the cover 110 is closed. In some embodiments, the cover covers the pump 154 and/or outlet nozzle 156 of a refill unit 150. In some embodiments, the cover 110 covers the entire refill unit 150, including a pump 154 and/or nozzle 156, and a container 152. In some embodiments, the cover 110 covers a portion of the pump 154 and/or container 152.

The cover 110 includes slides 112 that engage the rails 102 of the base 101 and allow the cover 110 to slide between the closed and open positions. The cover 110 forms a cavity 114 that encloses the lower portion of the refill unit 150 when it is installed in the dispenser 100. An aperture 116 in the bottom of the cover 110 allows fluid or foam dispensed from the refill unit 150 to exit the dispenser 110 for use. An optional drip tray 108 is attached to the base 101 below the mounting portion 106 and the cover 110 to catch unused fluid dispensed from the refill unit 150.

FIGS. 2A, 2B, 2C, and 2D illustrate an exemplary dispenser 200 having a latch 201. Latch 201 is an exemplary embodiment of the latch called out above. The latch 201 is exposed by removing the top plate 104 to more clearly show the components of the latch 201. The latch 201 is shown latched in FIG. 2A and unlatched in FIG. 2B. The actuators 232, 242 are locked in both FIGS. 2C and 2D. The latch 201 is shown latched in FIG. 2C and unlatched in FIG. 2D.

In addition to the latch 201, the dispenser 200 includes a back plate 202 and a cover 210. The latch 201 includes a release member 220, two actuation members 230, 240, and a lockout member 250. Openings 203 in the back plate allow the dispenser 200 to be mounted on a wall or other surface with screws (not shown) or other fastening means. In some embodiments, dispenser 200 is secured to a mounting surface by two sided tape (not shown). The release member 220, two actuation members 230, 240, and lockout member 250 of the latch 201 are retained in the back plate 202 by retainers 204. The retainers 204 allow these components move in a substantially linear direction. In some embodiments, these components may rotate, move toward, or away from the back plate 202 during operation of the latch 201.

The cover 210 includes slides 212 that slide along the rails 211 of the dispenser 200, allowing the cover 210 to slide between a closed position and an open position. Each slide 212 has a catch portion 214 with a latch aperture 216.

Figure 2B:
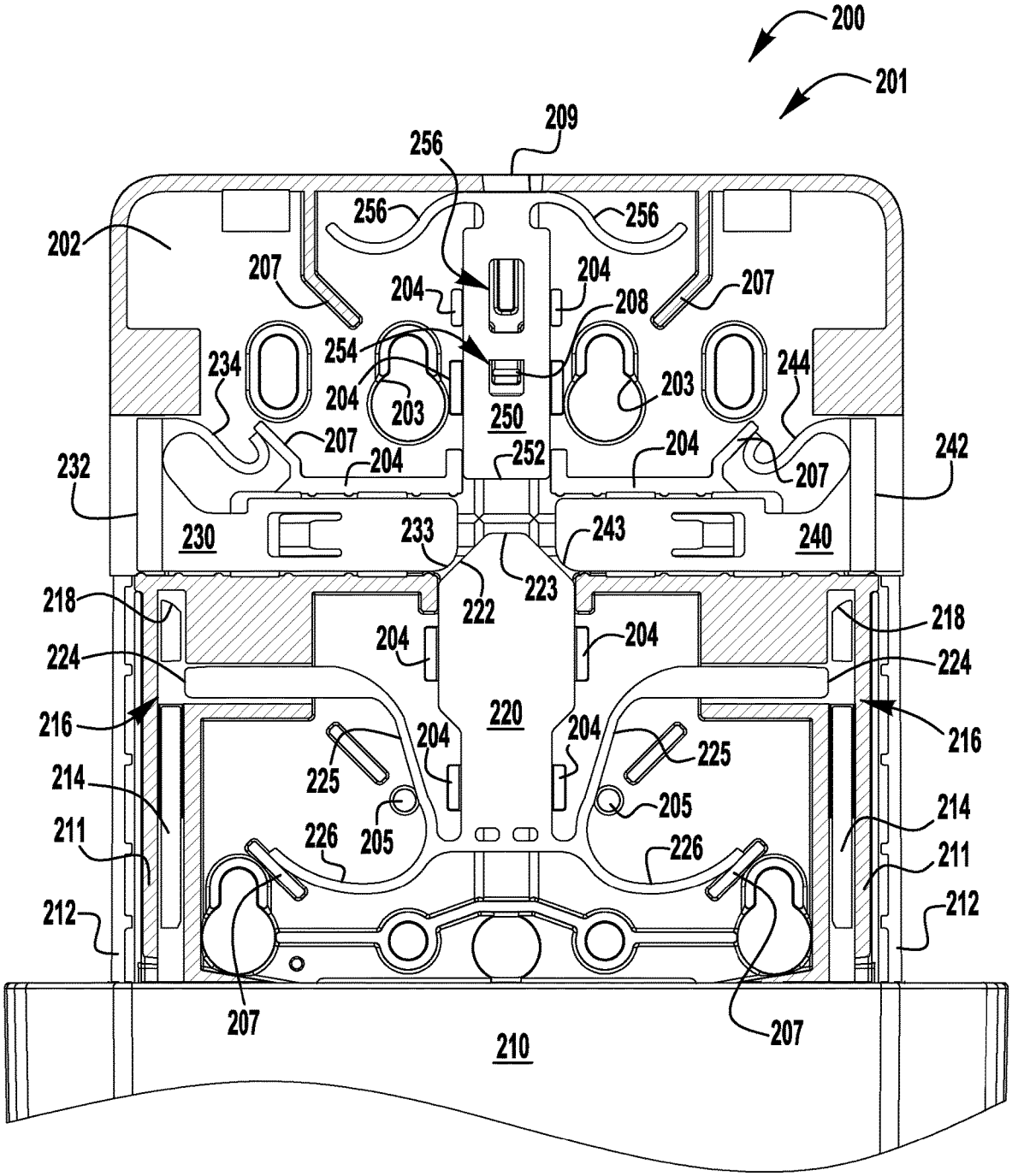
FIG. 2B is a elevational view of the exemplary dispenser (with the top plate removed) of FIG. 2A with an unlocked latch.
Figure 2C:
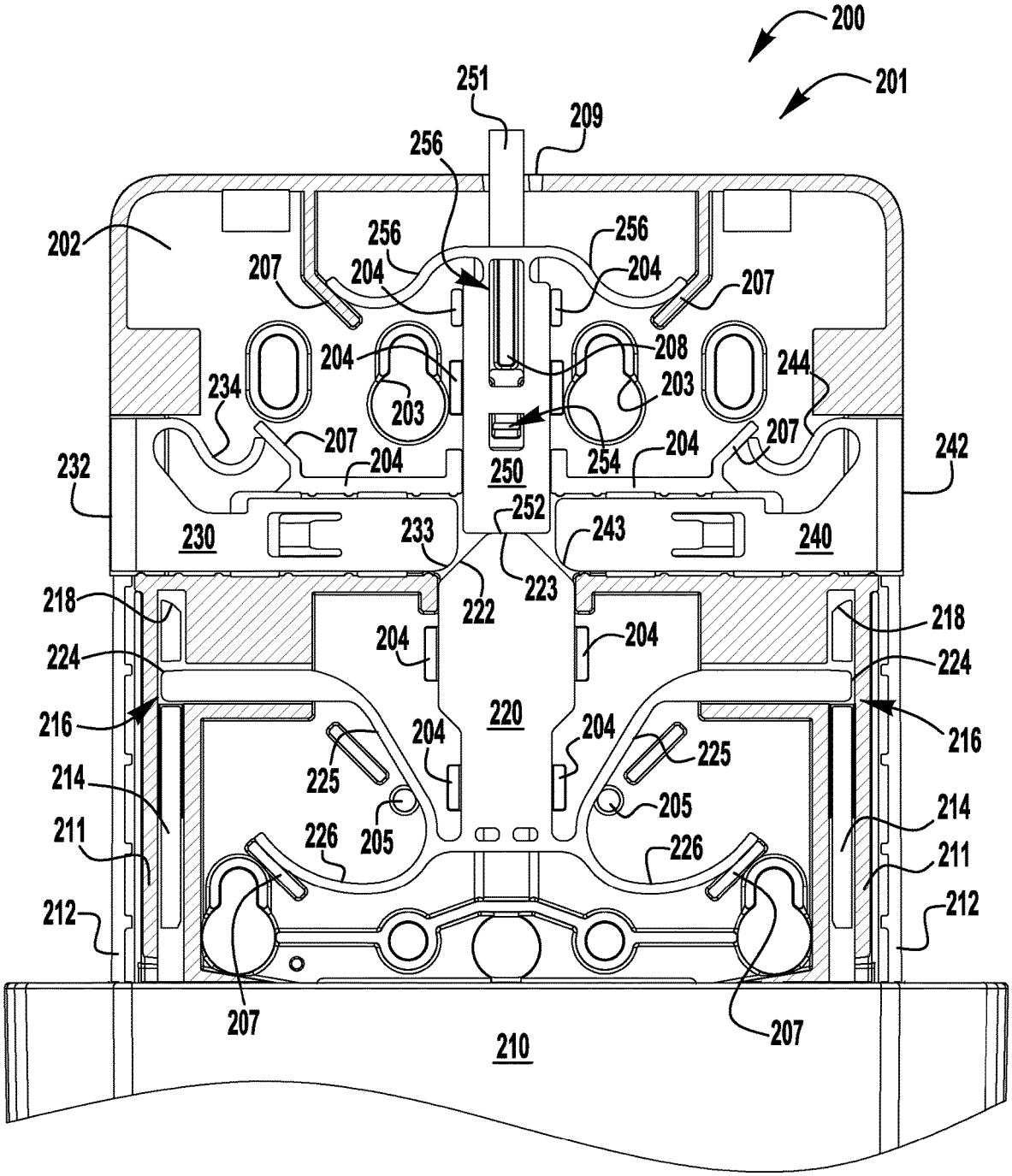
FIG. 2C is a elevational view of the exemplary dispenser (with the top plate removed) of FIG. 2A with a key inserted, the actuation members locked out, and the cover locked in its closed position.
Figure 2D:
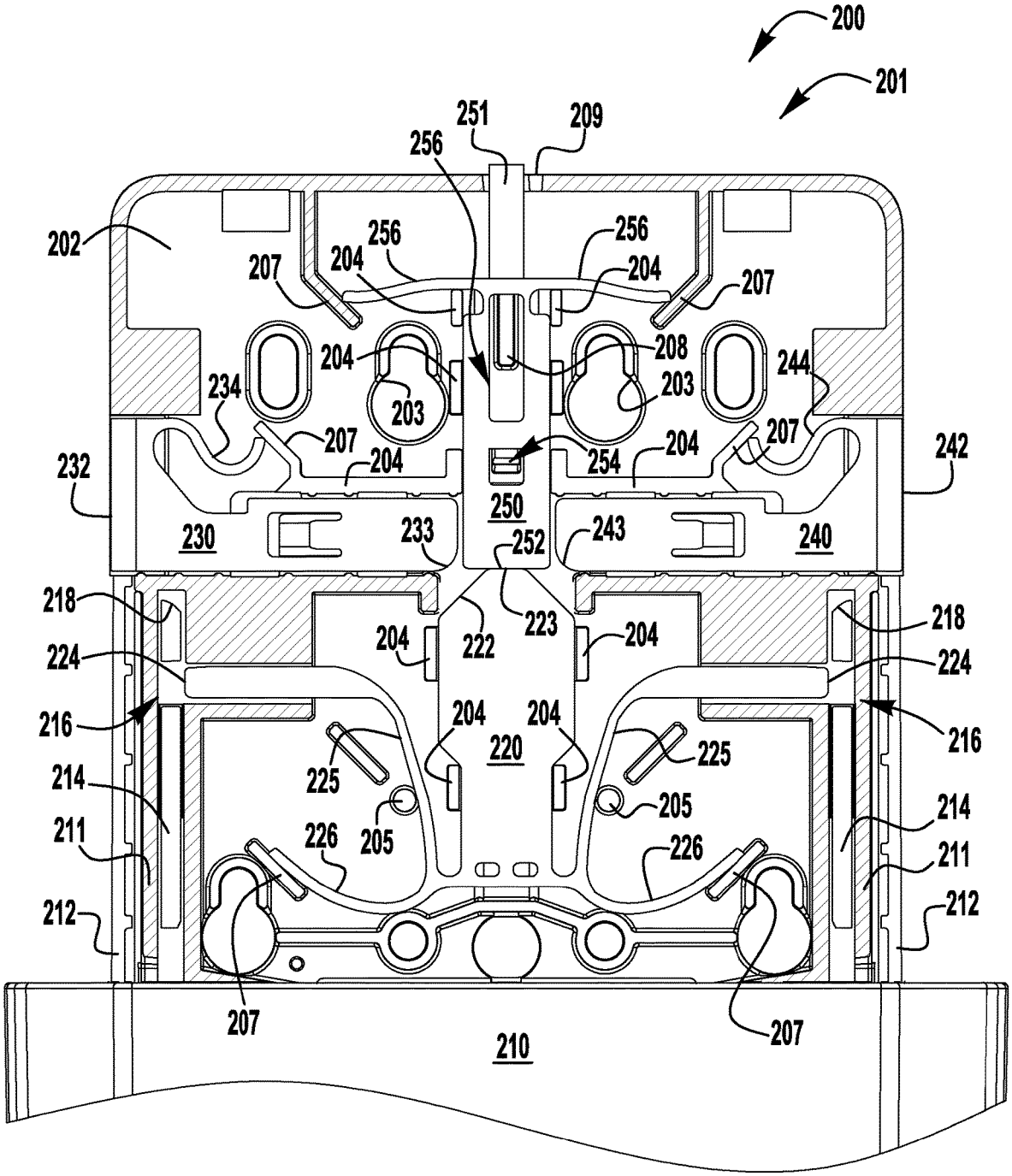
FIG. 2D is a elevational view of the exemplary dispenser (with the top plate removed) of FIG. 2A with the actuation members locked out and the key used to unlock the cover.

The release member 220 includes a cammed surface 222 that is angled, bolt members 224, and spring member 226. The release member 220 is moveable between a closed position (FIGS. 2A, 2C) and an open position (FIGS. 2B, 2D). Engagement of the cammed surface 222 by actuation member 230 and/or 240 moves the release member 220 downward from the closed position to the open position. In the open position, the resilient leg portions 225 of the bolt members 224 slide along projections 205 extending from the back plate 202 and the bolt members 224 are drawn inward along the bolt channels 206 and out of lock apertures 216 of slides 212, unlatching the cover 210 so that it may be slid downward.

Simultaneously, the spring members 226 are forced against projections 207 and elastically deformed, resisting the downward force exerted on the release member 220. When the force applied to the cammed surface 222 is removed, the spring members 226 return to their original shape, pushing the release member 220 upward to its closed position, thereby extending the bolt members 224 outward through the bolt channels 206. When the cover 210 is moved back upward to its home position, bolt members 224 slide into latch apertures 216, latching the cover 210 in place. The legs 225 of the bolt members 224 also bias against the projections 205, helping the release member 220 return to its latched position.

When the release member 220 is in the latched position, the bolt members 224 extend into the latch apertures 216 of the cover 210, retaining the cover 210 in its closed position. When the release member 220 is moved to its unlatched position, the bolt members 224 are retracted from the latch apertures 216 and the cover 210 can be opened. The release member 220 is biased to its latched position after the cover 210 has been opened and does not need to be manually moved again to close the cover 210. The slides 212 of the cover 210 include inclined portions 218 so that the cover 210 can be closed without moving actuation member 230 and/or 240. As the cover 210 moves upward, the inclined portions 218 of the slides 212 cause the bolt members 224 to retract into the bolt channels 206 so the cover 210 can be closed. When the cover 210 reaches the closed position, the bolt members 224 return to their latched position and engage the latch apertures 216 to secure the cover 210 in place.

The actuation members 230, 240 each include actuators 232, 242 and spring members 234, 244. The actuation members 230, 240 are moveable between a resting position (FIGS. 2A, 2C, 2D) and an actuated position (FIG. 2B). The actuation members 230, 240 are actuated by pressing inward on their actuators 232, 242. Moving one or both of the actuation members 230, 240 inward presses angled surfaces 233, 243 against the cammed surface 222 of the release member 220, moving the release member 220 from the latched to the unlatched position. The spring members 234, 244 are forced against projections 207 and elastically deformed, resisting the inward force exerted on the actuators 232, 242 during actuation. When the force on the actuators 232, 242 is removed, the spring members 234, 244 return to their original shape, pushing the actuation members 230, 240 outward to their resting positions, thereby removing the actuation force from the cammed surface 222 of the release member 220. The latch 201 may be actuated by either one or both of the actuation members 230, 240.

To prevent tampering with a refill unit (not shown) installed in the dispenser 200 by an unauthorized person, the actuation members 230, 240 can be locked with the lockout member 250. Locking the actuation members 230, 240 prevents the actuation members 230, 240 from moving inward to engage the release member 220. The lockout member 250 includes a blocking portion 252, a first opening 254, a second opening 256, and at least one spring member 258. The lockout member 250 is moveable between an unlocked position (FIGS. 2A, 2B), a locked position (FIG. 2C), and an actuating position (FIG. 2D).

In the unlocked position, an inclined protrusion 208 from the back plate 202 is located within the first opening 254 and restricts movement of the lockout member 250 so the actuation members 230, 240 are not accidentally locked out. The actuation members 230, 240 are locked out by inserting a key 251 through a key aperture 209 in the dispenser 200 to push the lockout member 250 downward to its locked position, overcoming the resistance provided by the inclined protrusion 208. In the locked position, the inclined protrusion 208 is located in the second opening 254 of the lockout member 250, preventing the lockout member 250 from returning to the unlocked position.

In the locked position, the lockout member 250 is disposed between the two actuation members 230, 240, preventing them from being moved inward to unlatch the latch 201. The latch 201 can still be unlatched, however, by inserting the key 251 into the key aperture 209 and pushing the lockout member 250 into an actuating position beyond its locked position. To unlatch the latch 201 while it is locked, the key 251 is inserted through the key aperture 209 to push the lockout member 250 downward until it engages the actuation surface 223 of the release member 220. Further downward movement of the key 251 pushes the release member 220 downward from its closed to open position, thereby unlatching the latch 201 and releasing the cover 210. The downward movement of the lockout member 250 forces the spring members 258 against the protrusions 207 causing them to elastically deform. When the force applied to the key 251 is removed, the spring members 258 return to their original shape, pushing the lockout member 250 back to its locked position. The release member 220 is then free to return to its latched position, latching the latch 201.

While the present invention has been illustrated by the description of embodiments thereof, and while the embodiments have been described in considerable detail, it is not the intention of the applicants to restrict or in any way limit the scope of the appended claims to such detail. Additional advantages and modifications will readily appear to those skilled in the art. Moreover, elements described with one embodiment may be readily adapted for use with other embodiments. Therefore, the invention, in its broader aspects, is not limited to the specific details, the representative apparatus and illustrative examples shown and described. Accordingly, departures may be made from such details without departing from the spirit or scope of the applicants' general inventive concept.

What is claimed is:

1. A dispenser comprising:

a base and a cover;

wherein the base has a first length and the cover has a second length and wherein the first length is longer than the second length;

the cover configured to slide with respect to the base between a first upper position and a second downward position;

a receptacle secured to the base for receiving a refill unit;

wherein when the cover is in the second downward position a refill unit may be inserted into the receptacle or removed from the receptacle;

wherein when the cover is in the first upper position the refill unit cannot be removed from the receptacle;

one or more latches for retaining the cover in the first upper position.

2. The dispenser of claim 1 wherein the cover is in the second downward position, at least a portion of the receptacle is exposed.

3. The dispenser of claim 1 wherein when the cover is in the first upper position, the base extends above the top of the cover.

4. The dispenser of claim 3 further comprising one or more pushbuttons for releasing the cover so that is may slide downward.

5. The dispenser of claim 4 further comprising a biasing member for biasing the one or more pushbuttons outward.

6. The dispenser of claim 5 further comprising a locking member for preventing the pushbuttons from moving inward to release the cover so that it may slide with respect to the base.

7. The dispenser of claim 6 wherein the lock member includes one or more biasing members for biasing the locking member towards a first direction.

8. The dispenser of claim 1 wherein the one or more latches comprises a biasing member to bias the one or more latches outward.

9. A dispenser comprising:

a refill unit having a battery pod;

a pump for pumping fluid out of the refill unit;

a receptacle on the dispenser for receiving the battery pod; and a sliding cover;

wherein the sliding cover slides between an upper first position and a second downward position; and wherein when the sliding cover is in the upper first position the pump is behind the sliding cover; and wherein when the sliding cover is in the lower second position, the pump is behind the cover.

10. The dispenser of claim 9, wherein the pump is connected to the refill unit.

11. The dispenser of claim 9, further comprising a latch.

12. The dispenser of claim 11 wherein the latch comprises:

at least one actuator; and a release member;

wherein movement of the at least one actuator moves the release member.

13. The dispenser of claim 12, wherein the release member may be moved without the actuator moving.

14. The dispenser of claim 9, further comprising a locking member moveable between a locked state and an unlocked state.

15. The dispenser of claim 14, wherein the locking member locks the at least one actuator.

16. A dispenser comprising:

at least one rail having a first end and a second end;

a latch disposed at the first end of the rail;

a sliding cover slideable along the at least one rail between a upper closed position and a lower open position; and a container;

wherein when the cover is in the closed position, the cover covers at least a portion of the container and leaves a portion of the container exposed;

wherein the cover is held in the closed position by the latch; and wherein the container cannot be removed when the cover is held in the closed position.

17. The dispenser of claim 16, further comprising a pump and wherein when the cover is in the closed upper position, the pump is located behind the cover; and wherein when the cover is in the lower open position, the pump is accessible.

18. The dispenser of claim 16, wherein the latch further comprises:

at least one actuator; and a release member;

wherein movement of the at least one actuator moves the release member.

19. The dispenser of claim 16, wherein the release member may be moved without the actuator moving.

20. The dispenser of claim 16, further comprising a locking member moveable between a locked state and an unlocked state.

* * * * *